US012018877B2

(12) United States Patent
Jackson et al.

(10) Patent No.: US 12,018,877 B2
(45) Date of Patent: Jun. 25, 2024

(54) ICE BIN INCLUDING AN ICE CONVEYANCE AND CRUSHER ASSEMBLY

(71) Applicant: Electrolux Home Products, Inc., Charlotte, NC (US)

(72) Inventors: Kwashun S. Jackson, Anderson, SC (US); Thomas McCollough, Anderson, SC (US); Zhuochen Shi, Clemson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 318 days.

(21) Appl. No.: 17/371,632

(22) Filed: Jul. 9, 2021

(65) Prior Publication Data

US 2023/0009119 A1 Jan. 12, 2023

(51) Int. Cl.
*F25C 5/04* (2006.01)
*F25C 5/20* (2018.01)

(52) U.S. Cl.
CPC ..... *F25C 5/046* (2013.01); *F25C 5/22* (2018.01); *F25C 2400/10* (2013.01)

(58) Field of Classification Search
CPC ..... F25C 5/046; F25C 5/22; F25C 2400/10; F25C 5/20
See application file for complete search history.

(56) References Cited

U.S. PATENT DOCUMENTS 957,038 A 5/1910 Dalgety et al.
2,237,078 A 4/1941 Lilly
2,905,397 A 9/1959 Angelis et al.
5,947,342 A 9/1999 Song
7,278,275 B2 10/2007 Vodlewede et al.
7,954,738 B2 6/2011 Lee et al.
8,387,408 B2 3/2013 Kim et al.
9,310,124 B2 4/2016 Chase et al.
9,995,522 B2 6/2018 Choo
10,092,029 B2 10/2018 Bertocchi
(Continued)

FOREIGN PATENT DOCUMENTS

JP 657118272 7/1982
JP H0569575 9/1993
(Continued)

OTHER PUBLICATIONS

International Search Report and Written Opinion for PCT/US2022/036095, dated Oct. 25, 2022, 31 pages.

*Primary Examiner* — Elizabeth J Martin
(74) *Attorney, Agent, or Firm* — Pearne & Gordon LLP

(57) ABSTRACT

An ice bin for a refrigerator appliance, the ice bin includes a storage body. An auger, rotatably driven by an auger motor, extends within the storage body and has first and second ends. The auger is rotatably driven about a first axis. A first crusher roller is disposed at the second end of the auger and is coupled thereto to rotate together with the auger about the first axis. A second crusher roller is disposed on an axle extending along a second axis, the second crusher roller is freely rotatable about the axle. The second crusher roller is movable between a first position and a second position. When the second crusher roller is in the first position, the first crusher roller and the second crusher roller are spatially arranged and configured to grind the produced ice pieces into crushed ice.

8 Claims, 10 Drawing Sheets

(56) References Cited

U.S. PATENT DOCUMENTS

| | | | | |
|---|---|---|---|---|
| 10,571,182 | B2 | 2/2020 | Li et al. | |
| 10,584,907 | B2 | 3/2020 | Laible et al. | |
| 11,125,486 | B2 | 9/2021 | Stout | |
| 2008/0156018 | A1 | 7/2008 | Lee et al. | |
| 2010/0281906 | A1* | 11/2010 | Chung | F25C 5/046 62/320 |
| 2012/0204592 | A1 | 8/2012 | Foster et al. | |
| 2015/0176882 | A1* | 6/2015 | Jeong | F25D 23/028 62/344 |
| 2019/0331385 | A1 | 10/2019 | Jeong | |

FOREIGN PATENT DOCUMENTS

| | | |
|---|---|---|
| KR | 100693096 | 3/2007 |
| KR | 101450652 | 10/2014 |

* cited by examiner

ICE BIN INCLUDING AN ICE CONVEYANCE AND CRUSHER ASSEMBLY

FIELD OF THE INVENTION

This application relates generally to an ice conveyance and crusher assembly within an ice bin of a refrigerator appliance, and more particularly, an ice conveyance and crusher assembly having a first crusher roller rotatably driven by an auger motor and a second crusher roller that is freely rotatable, wherein the first and second crusher rollers are configured to grind 'whole cube' ice pieces into 'crushed' ice pieces.

BACKGROUND OF THE INVENTION

Conventional appliances, including refrigeration appliances, often include ice makers that manufacture ice pieces. The produced ice pieces are discharged (from the ice maker) into an ice bin. Upon user request, the ice pieces are transported out of the ice bin and are guided to a dispenser. This is generally accomplished by an auger rotatably disposed within the ice bin that guides the ice pieces forward, towards an outlet. Some conventional ice bins also include a crusher system that chop 'whole' ice pieces into 'crushed' ice pieces. Such crusher systems include sharp, crusher blades that rotate in order to chop the 'whole' ice pieces.

The aforementioned conventional crusher systems generally are only able to produce a single size of 'crushed' ice pieces. That is, the conventional crusher systems are not adjustable to yield varying sized 'crushed' ice pieces (based on user preference/selection). Moreover, the crusher blades often become warped (i.e., bent) over time due to harsh crushing conditions. Accordingly, servicing of the crusher blades is often required to maintain the functionality of the crusher system.

BRIEF SUMMARY OF THE INVENTION

In accordance with one aspect, there is provided an ice bin for a refrigerator appliance. The ice bin includes a storage body defining an ice storage compartment therein that is configured to receive and store produced ice pieces. An auger is rotatably driven by an auger motor. The auger extends within the storage body and has first and second ends. The auger is rotatably driven about a first axis. A first crusher roller is disposed at the second end of the auger and is coupled thereto to rotate together with the auger about the first axis. A second crusher roller is disposed on an axle extending along a second axis, the second crusher roller is freely rotatable about the axle. The second crusher roller is movable between a first position and a second position. When the second crusher roller is in the first position, the first crusher roller and the second crusher roller are spatially arranged and configured to grind the produced ice pieces into crushed ice.

In accordance with another aspect, there is provide an ice bin for a refrigerator appliance. The ice bin includes a storage body defining an ice storage compartment therein that is configured to receive and store produced ice pieces. An auger is rotatably driven by an auger motor. The auger extends within the storage body and has first and second ends. A drive gear is disposed at the second end of the auger and is coupled thereto to rotate together with the auger. A first crusher roller is disposed on a first axle extending along a first axis. The first axis is parallel to a second axis on which the auger is rotatably driven. The first crusher roller is configured to rotate about the first axis. The first crusher roller matingly engages with the drive gear such that the first crusher roller is rotatably driven by the auger motor.

Moreover, a second crusher roller is disposed on a second axle extending along a third axis. The second crusher roller is freely rotatable about the second axle. A spatial arrangement of the first and second crusher rollers is adjustable between a first orientation and a second orientation. In the first orientation, the first and second crusher rollers are configured to grind the produced ice pieces into crushed ice. In the second orientation, the first and second crusher rollers are not configured to grind the produced ice pieces.

In accordance with yet another aspect, there is provided an ice bin for a refrigerator appliance. The ice bin includes a storage body defining an ice storage compartment therein that is configured to receive and store produced ice pieces. An auger is rotatably driven by an auger motor. The auger extends within the storage body and has first and second ends. A first drive gear is disposed at the second end of the auger and is coupled thereto to rotate together with the auger. A second drive gear is disposed on a first axle extending along a first axis, which is parallel to a second axis on which the auger is rotatably driven. The second drive gear is configured to rotate about the first axis and the second drive gear matingly engages the first drive gear.

A first crusher roller is disposed on the first axle and is configured to rotate together with the second drive gear such that the first crusher roller is rotatably driven by the auger motor. A second crusher roller is disposed on a second axle extending along a third axis. The second crusher roller is freely rotatable about the second axle. The second crusher roller is movable between a first position and a second position. When the second crusher roller is in the first position the first crusher roller and the second crusher roller are spatially arranged and configured to grind the produced ice pieces into crushed ice.

DESCRIPTION OF EXAMPLE EMBODIMENTS

Figure 1:
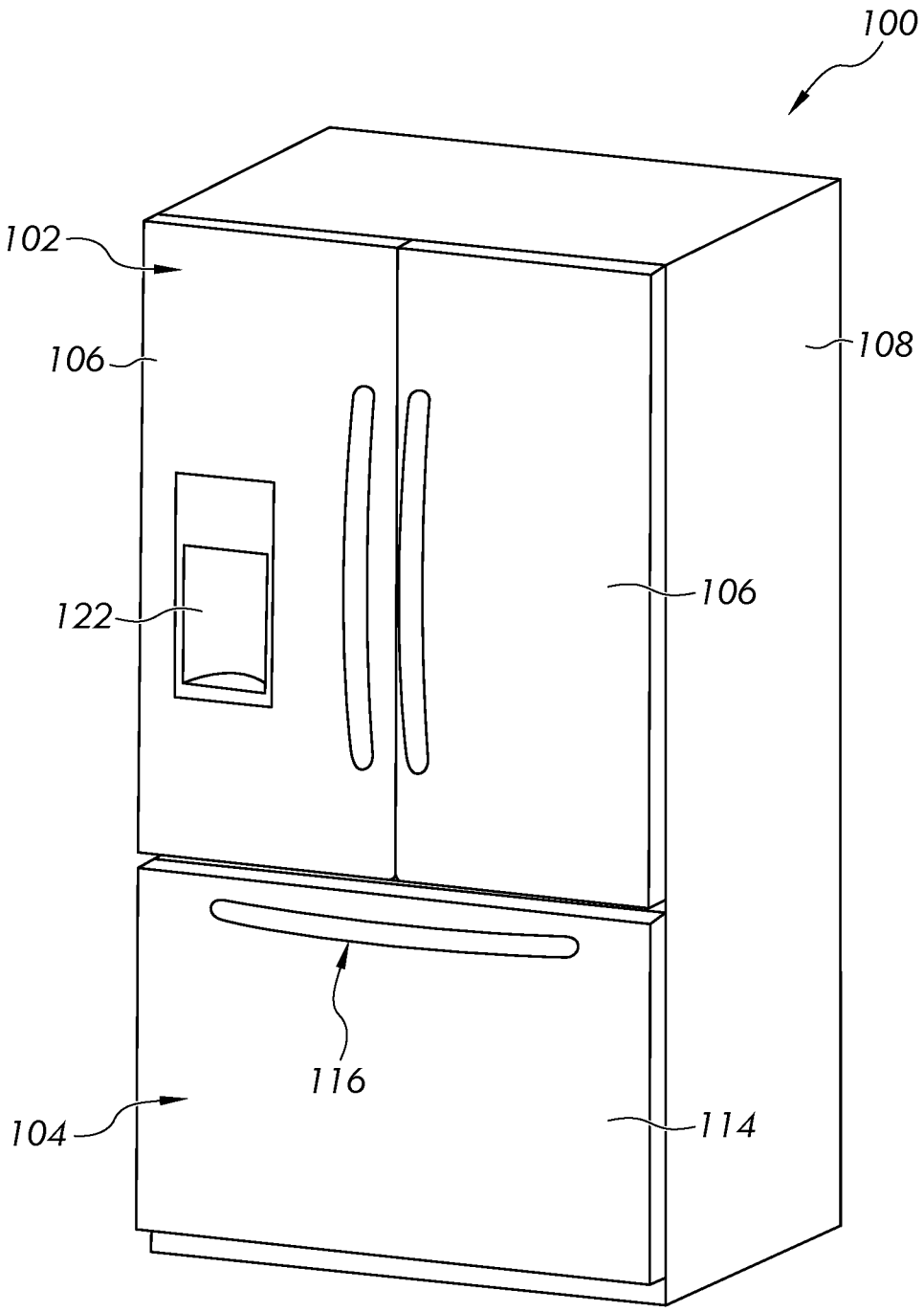
FIG. 1 is a front perspective view of an example refrigeration appliance.

Referring now to the drawings, FIG. 1 shows a refrigeration appliance in the form of a domestic refrigerator, indicated generally at 100. Although the detailed description that follows concerns a domestic refrigerator 100, the invention can be embodied by refrigeration appliances other than a domestic refrigerator 100. Further, an embodiment is described in detail below, and shown in the figures as a bottom-mount configuration of the refrigerator 100, including a fresh-food compartment 102 disposed vertically above a freezer compartment 104. Still, it is to be understood that the refrigerator 100 can have any desired configuration including at least a fresh-food compartment and/or a freezer compartment, such as a top mount refrigerator (freezer disposed above the fresh-food compartment), a side-by-side refrigerator (fresh-food compartment is laterally next to the freezer compartment), a standalone refrigerator or freezer, a refrigerator having a compartment with a variable climate (i.e., can be operated as a fresh-food or a freezer compartment), etc.

One or more doors 106 are pivotally coupled to a cabinet 108 of the refrigerator 100 to restrict and grant access to the fresh-food compartment 102. The door(s) 106 can include a single door that spans the entire lateral distance across the entrance to the fresh-food compartment 102, or can include a pair of French-type doors 106, as shown in FIG. 1, that collectively span the entire lateral distance of the entrance to the fresh-food compartment 102 to enclose the fresh-food compartment 102.

Figure 2:
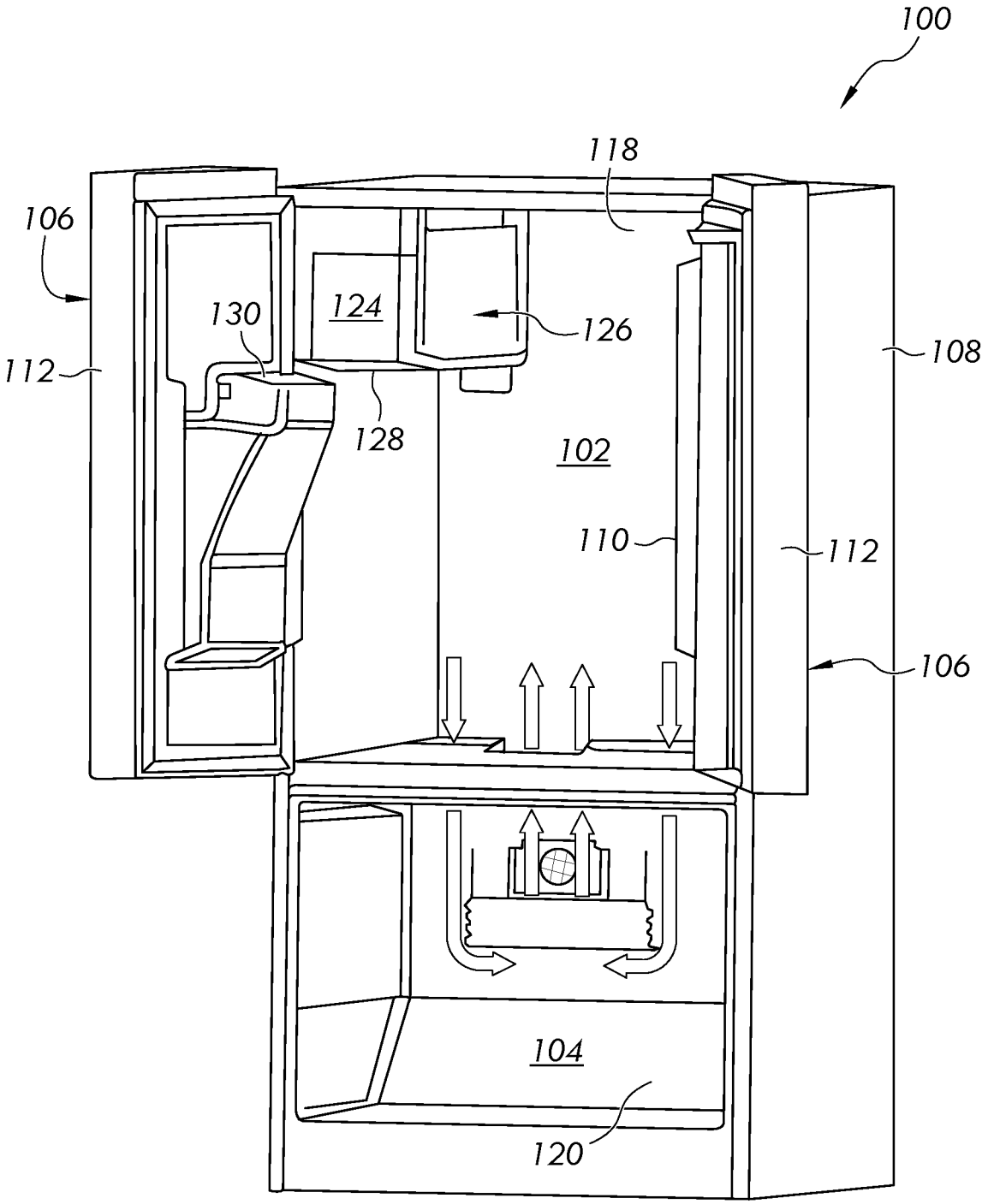
FIG. 2 is a front perspective view of the refrigeration appliance showing doors of a fresh-food compartment in an opened position and a door of a freezer compartment removed.

As shown in FIG. 2, a center flip mullion 110 is pivotally coupled to at least one of the doors 106 to establish a surface against which a seal provided to the other one of the doors 106 can seal the entrance to the fresh-food compartment 102 at a location between opposing side surfaces 112 of the doors 106. The center flip mullion 110 can be pivotally coupled to the door 106 to pivot between a first orientation that is substantially parallel to a planar surface of the door 106 when the door 106 is closed, and a different orientation when the door 106 is opened. The externally-exposed surface of the center flip mullion 110 is substantially parallel to the door 106 when the center flip mullion 110 is in the first orientation, and forms an angle other than parallel relative to the door 106 when the center flip mullion 110 is in the second orientation. The seal and the externally-exposed surface of the center flip mullion 110 cooperate approximately midway between the lateral sides of the fresh-food compartment 102.

Moving back to FIG. 1, the freezer compartment 104 is arranged vertically beneath the fresh-food compartment 102. A drawer assembly (not shown) including one or more freezer baskets (not shown) can be withdrawn from the freezer compartment 104 to grant a user access to food items stored in the freezer compartment 104. The drawer assembly can be coupled to a freezer door 114 that includes a handle 116. When a user grasps the handle 116 and pulls the freezer door 114 open, at least one or more of the freezer baskets is caused to be at least partially withdrawn from the freezer compartment 104.

The freezer compartment 104 is used to freeze and/or maintain articles of food stored therein in a frozen condition. For this purpose, the freezer compartment 104 is in thermal communication with the freezer evaporator that removes thermal energy from the freezer compartment 104 to maintain the temperature therein at a temperature of 0° C. or less during operation of the refrigerator 100, preferably between 0° C. and −50° C., more preferably between 0° C. and −30° C. and even more preferably between 0° C. and −20° C.

Moving back to FIG. 2, the refrigerator 100 further includes an interior liner comprising a fresh-food liner 118 and a freezer liner 120 which define the fresh-food and freezer compartments 102, 104, respectively. The fresh-food compartment 102 is located in the upper portion of the refrigerator 100 in this example and serves to minimize spoiling of articles of food stored therein. The fresh-food compartment 102 accomplishes this by maintaining the temperature in the fresh-food compartment 102 at a cool temperature that is typically above 0° C., so as not to freeze the articles of food in the fresh-food compartment 102. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh-food compartment 102 to maintain the temperature therein greater than 0° C. preferably between 0° C. and 10° C., more preferably between 0° C. and 5° C. and even more preferably between 0.25° C. and 4.5° C. For alternate embodiments, a separate fresh-food evaporator (not shown) can optionally be dedicated to separately maintaining the temperature within the fresh-food compartment 102 independent of the freezer compartment 104. According to an embodiment, the temperature in the fresh-food compartment 102 can be maintained at a cool temperature within a close tolerance of a range between 0° C. and 4.5° C., including any subranges and any individual temperatures falling with that range. For example, other embodiments can optionally maintain the cool temperature within the fresh-food compartment 102 within a reasonably close tolerance of a temperature between 0.25° C. and 4° C.

With respect to FIG. 1, a dispenser 122 is disposed at one of the doors 106 and is provided to dispense liquid (e.g., water) and/or ice pieces therefrom. As shown, the dispenser 122 is provided on an exterior of one of the doors 106 such that a user can acquire water and/or ice pieces without opening said door 106. Alternatively, it is contemplated that the dispenser 122 can be positioned on an interior of one of the doors 106 or on an interior wall of the refrigerator 100 such that a user must first open said door 106 before interacting with the dispenser 122.

In operation, when a user desires ice (e.g., ice pieces), the user interacts with an actuator (e.g., lever, switch, proximity sensor, etc.) to cause frozen ice pieces to be dispensed from an ice bin 124 (FIG. 2) of an ice maker 126. Ice pieces stored within the ice bin 124 can exit the ice bin 124 through an aperture 128 and be delivered to the dispenser 122 via an ice chute 130. In the embodiment shown, the ice chute 130 extends at least partially through the door 106 between the dispenser 122 and the ice bin 124. As further shown, the ice maker 126 is located within the fresh-food compartment 102 and, more particularly, at an upper corner defined by the fresh-food liner 118. Alternatively, the ice maker 126 (and possibly the ice bin 124) can be mounted to an interior surface of the door 106. It is further contemplated that the ice maker 126 and the ice bin 124 can be separate elements, in which one remains within the fresh-food compartment 102 and the other resides on the door 106. In alternative embodiments (not shown), the ice maker 126 is located within the freezer compartment 104. In this configuration, both of the ice maker 126 and the ice bin 124 can be located wholly within the freezer compartment 104. In an alternate configuration, although still disposed within the freezer compartment 104, at least the ice maker 126 (and possibly the ice bin 124) is mounted to an interior surface of the freezer door 114. It is contemplated that the ice maker 126 and ice bin 124 can be separate elements, in which one remains within the freezer compartment 104 and the other is on the freezer door 114. For example, the ice maker 126 can be positioned within the freezer compartment 104 and the ice bin 124 can be located on the freezer door 114.

In further alternative embodiments, it is contemplated that the ice maker 126 and the ice bin 124 can reside in separate compartments of the refrigerator 100. For example, the ice maker 126 can be positioned within the freezer compartment 104 and the ice bin 124 can be disposed within the fresh-food compartment 102. Alternatively, the ice maker 126 can be positioned within the fresh-food compartment 102 and the ice bin 124 can be disposed within the freezer compartment 104. Further still, where the refrigerator 100 is a multi-compartment refrigerator including a variable climate compartment, both the ice maker 126 and the ice bin 124 can be disposed within said variable climate compartment, or one of the ice maker 126 and the ice bin 124 can be positioned within the variable climate compartment while the other is disposed within a separate compartment (e.g., the fresh-food compartment 102 or the freezer compartment 104).

Additionally, when a user desires water, the user interacts with the actuator to acquire water from the dispenser 122. Generally, water is directed through a water circuit of the refrigerator 100 wherein it is pumped to the dispenser 122 from an external source (not shown). Typically, such water circuits include a series of water lines (e.g., conduits, tubes, etc.) to transport the water from the external source to the dispenser 122. Filters and water storage tanks are often also employed to filter the water passing therethrough and to store the water (either filtered or unfiltered) for subsequent downstream use.

Figure 3:
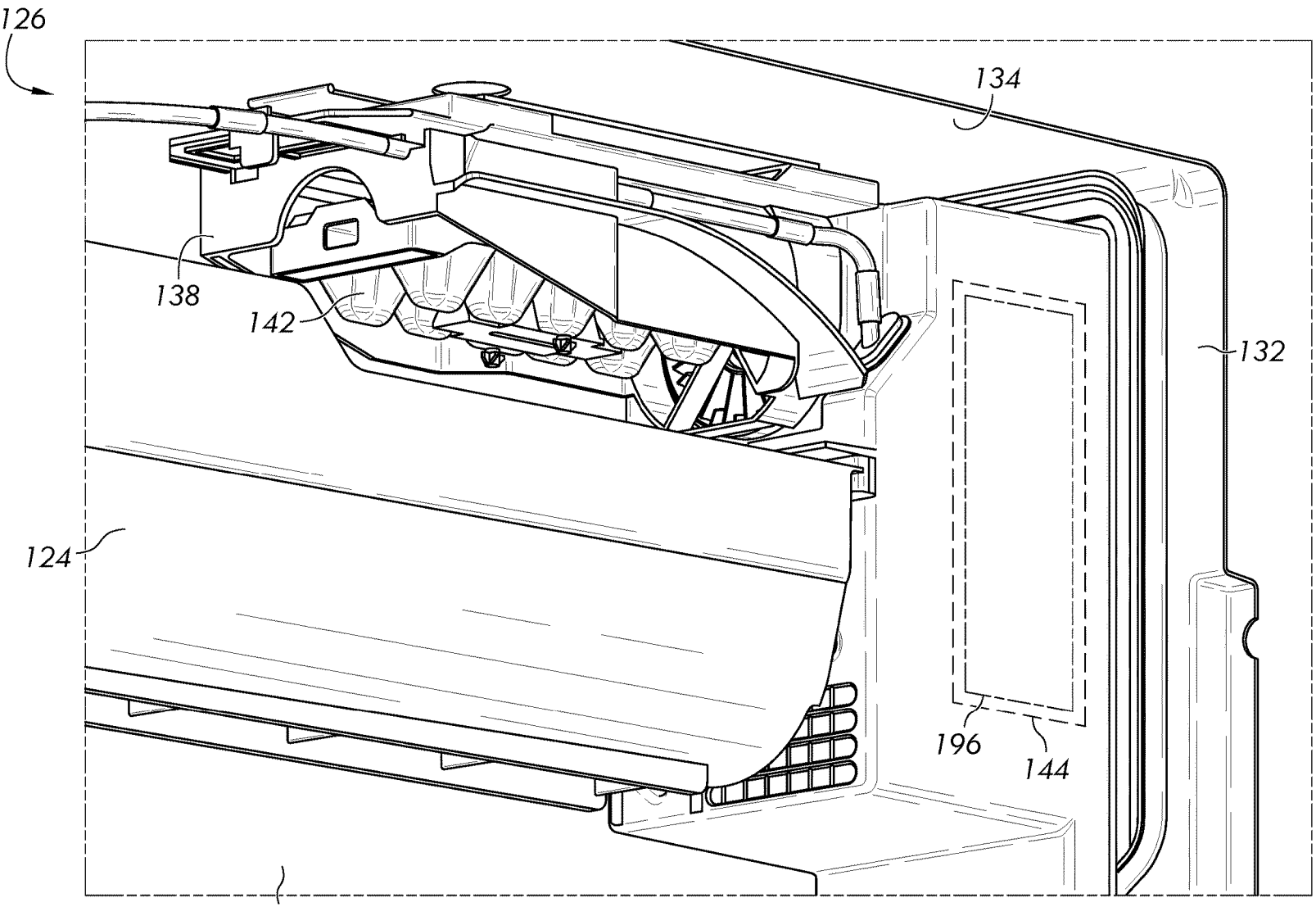
FIG. 3 is a partial, front sectional view of an interior of an upper portion of the fresh-food compartment, showing an ice maker.

Moving on to FIG. 3, the ice maker 126 is shown as being disposed at an upper corner of the fresh-food compartment 102, and more particularly, is shown with an insulated housing thereof removed (for simplicity). Specifically, the ice maker 126 is located adjacent a rear wall 132, top wall 134, and side wall 136 of the fresh-food liner 118. Alternatively, the ice maker 126 can be positioned at other locations within the fresh-food compartment 102. For example, the ice maker 126 can be positioned at a lower corner of the fresh-food compartment 102 (i.e., adjacent a horizontal mullion that separates the fresh-food and freezer compartments 102, 104), on a storage shelf located within the fresh-food compartment 102, or even on/within one of the doors 106 that provides selective access to the fresh-food compartment 102 (as further discussed below).

The ice maker 126 is shown as including an ice maker frame 138, the ice bin 124, and an air handler 140. The air handler 140 is secured adjacent the rear wall 132 of the fresh-food liner 118, and both the ice maker frame 138 and the ice bin 124 extend outwards therefrom towards a front of the refrigerator 100. Additionally, the ice maker frame 138 is disposed vertically above the ice bin 124 and houses an ice tray 142 therein. Due to this configuration, after the ice pieces have been formed, the ice pieces can then be dispensed to the ice bin 124 in an efficient manner. For example, in a "twist tray" embodiment, the ice tray 142 may rotate about a horizontal axis until the ice pieces face the ice bin 124 and are subsequently ejected from the ice tray 142. In a fixed tray embodiment (not shown), the ice tray 142 can remain stationary while a sweeper arm rotates to harvest the ice pieces out of the ice tray 142 and push them into the ice bin 124. Further, an ice maker evaporator 144 is disposed within (i.e., positioned behind) the air handler 140 (which includes a fan to blow the cold air throughout the ice maker compartment) and is configured to cool water in the ice tray 142 to a temperature sufficient for ice piece production. In alternative embodiments (not shown), the ice maker evaporator 144 could include a refrigerant tube that is in direct contact with the ice tray 142 to freeze the water directly via thermal conduction.

Figure 4:
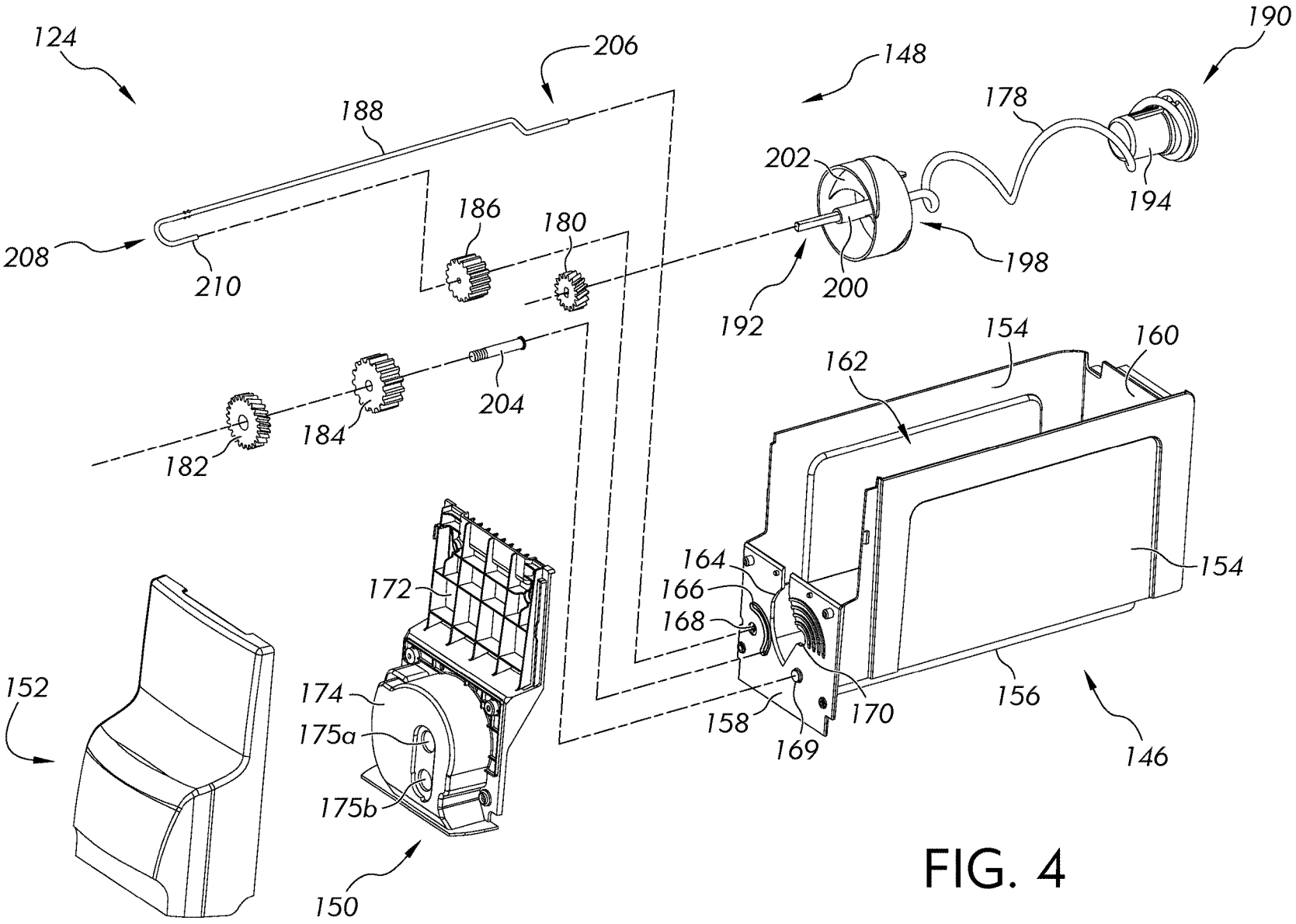
FIG. 4 is an exploded view of select features of an ice bin and a first embodiment of a conveyance and crusher assembly.

Now moving on to FIG. 4, an example of the ice bin 124 is depicted with select features thereof shown in an exploded view. Specifically, the ice bin 124 includes a storage body 146, a conveyance and crusher assembly 148 (i.e., a first embodiment of a conveyance and crusher assembly), a crusher cover 150, and a front cover 152. As shown, the storage body 146 includes a pair of opposite side walls 154 spaced apart from one another by a bottom wall 156. The storage body 146 further includes front and rear walls 158, 160 disposed at opposite, front and rear portions, respectively of the storage body 146. Each of the front and rear walls 158, 160 extends between the opposite side walls 154, and are spaced apart from one another by the bottom wall 156 (e.g., in a depth direction of the fresh-food compartment 102). The side walls 154, bottom wall 156, front wall 158, and rear wall 160 of the storage body 146 collectively define an ice storage compartment 162 therein that receives and stores produced ice pieces.

The front wall 158 of the storage body 146 has a conveyance cut-out 164 (i.e., a first cut-out) formed therein that is configured to permit 'whole' ice pieces stored within the ice storage compartment 162 to pass therefrom and into a crusher compartment, discussed further below. A roller adjustment cut-out 166 (i.e., a second cut-out) is also formed in the front wall 158 and is generally arc-shaped. A rod cut-out 168 (i.e., a third cut-out) is further formed in the front wall 158. Notably, the rod cut-out 168 is positioned at a center of curvature of the arc-shaped roller adjustment cut-out 166. That is, in one example, all radial distances from the rod cut-out 168 to any point along the curvature of the roller adjustment cut-out 166 are equal. However, it is contemplated that the roller adjustment cut-out 166 could have an asymmetrical curvature whereby radial distances along its length measured to the rod cut-out 168 are non-equal. Further still, an axle cut-out 169 is formed in the front wall 158 and is configured to receive an axle (discussed further below). It is to be understood that each of the conveyance cut-out 164, the roller adjustment cut-out 166, the rod cut-out 168, and the axle cut-out 169 are separate apertures defined in and formed completely through the front wall 158 of the storage body 146. As further shown, a notch 170 is defined in the conveyance cut-out 164 and is configured to receive a cylinder of an ice guide therein, as will be further discussed below.

The crusher cover 150 includes an upper wall 172 and a crusher housing 174 disposed thereunder. In particular, the crusher housing 174 is stepped-back or recessed from the upper wall 172. First and second apertures 175*a*, 175*b* are formed in the crusher housing and are configured to support distal ends of rotatable elements, discussed further below. The upper wall 172 is configured to be disposed adjacent front edges of the opposite side walls 154 of the storage body 146 and the crusher housing 174 is disposed adjacent the front wall 158 of the storage body 146. Notably, the front wall 158 of the storage body 146 and the crusher housing 174 of the crusher cover 150 together define a crusher compartment 176 (best shown in FIG. 6). The shape of the front cover 152 generally contours that of the crusher cover 150, and is configured to be an aesthetic, external cover of the ice maker compartment.

Figure 6:
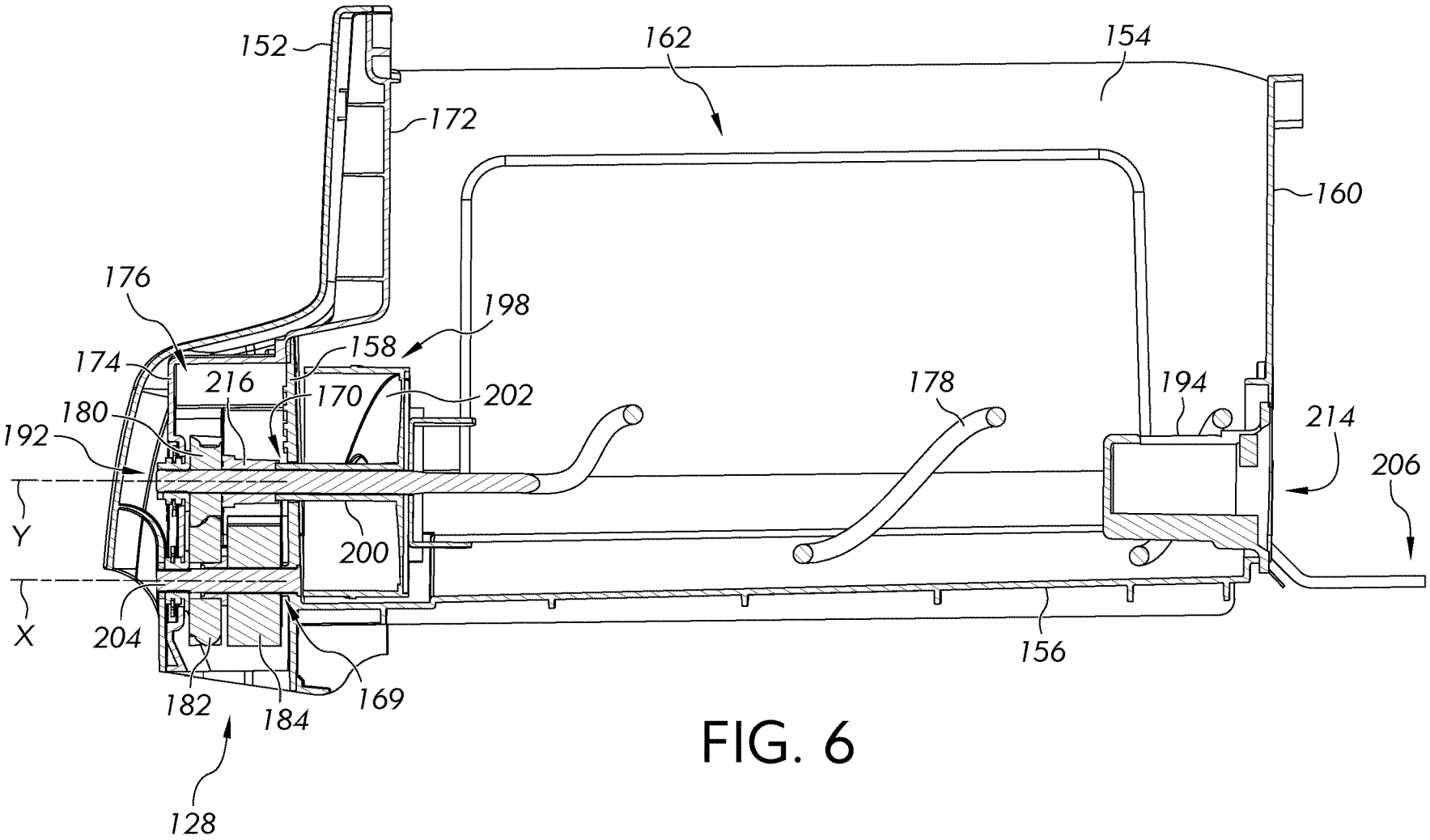
FIG. 6 is a side, cross-sectional view of the conveyance and crusher assembly installed within the ice bin.

As further shown in FIG. 4, the conveyance and crusher assembly 148 includes an auger 178, first and second drive gears 180, 182, first and second crusher rollers 184, 186, and a control rod 188. The auger 178 is a bar that extends from a first end 190 to a second end 192 and has a generally helix-shaped middle portion. The first end 190 is wrapped in a circular shape around a cylinder-shaped drive cup 194, and the second end 192 is linear (i.e., not curved). Of note, the drive cup 194 is hollow (as shown in FIG. 6) and is configured to receive a rotating drive arm of an auger motor 196 (schematically depicted in FIG. 3). An ice guide 198 is disposed at the second end 192 of the auger 178 and includes a hollow cylinder 200 that receives the second end 192 of the auger 178. As further shown, the ice guide 198 includes a helically shaped slide 202 configured to guide ice pieces in a linear direction. Of note, the ice guide 198 is attached to the second end 192 of the auger 178 (via the cylinder 200) such that as the auger 178 rotates (as described below), the ice guide 198 likewise rotates and guides ice from the ice storage compartment 162, through the conveyance cut-out 164 and into the crusher compartment 176 via the slide 202.

The first and second drive gears 180, 182 are depicted as helical gears. However, it is to be understood that the first and second drive gears 180, 182 can be a different type of gear (e.g., spur gear). As further shown, the first and second crusher rollers 184, 186 are depicted as spur gears, having teeth radially extending from a body and being spaced one from the other along a circumferential direction thereof. It is to be understood that the first and/or second crusher roller 184, 186 can have a different configuration. For example, the first and/or second crusher roller 184, 186 can be a simple wheel-shaped body with no teeth, a wheel-shaped body with various configurations of teeth or other ice-crushing structures disposed thereon, a helical gear, etc. Moreover, while it is shown that that the first and second crusher rollers 184, 186 have the same configuration with respect to one another, it is contemplated that the first crusher roller 184 can have a configuration different from the second crusher roller 186. As will be further discussed below, the second drive gear 182 and the first crusher roller 184 are both attached to a first (rotatable) axle 204 received within the axle cut-out 169 in the front wall 158. Finally, the control rod 188 is an elongated bar having a rear end 206 and a front end 208. The front end 208 has a U-shaped bend that terminates in a second axle 210.

Assembly of the ice bin 124 will now be discussed. It is to be understood that the example embodiment of the ice bin 124 (described above) need not occur in the order detailed below, and may include additional or fewer assembly steps. Initially, with respect to FIG. 6 (depicting a side, cross-sectional view of the ice bin 124 in an assembled state), the first axle 204 is inserted into the axle cut-out 169 (from within the ice storage compartment 162) and is aligned on a first axis 'X.' Thereafter, the first crusher roller 184 is inserted onto the first axle 204 and attached thereto. Next, the second drive gear 182 is inserted onto the first axle 204 and attached thereto. Notably, the first axle 204, the first crusher roller 184 and the second drive gear 182 are coaxial, and the first crusher roller 184 and the second drive gear 182 are attached to the first axle 204 such that when the second drive gear 182 rotates, so too does the first crusher roller 184.

Subsequently, the auger 178 is placed within the ice storage compartment 162 of the storage body 146. In particular, the auger 178 is received within the ice storage compartment 162 such that the drive cup 194 and the ice guide 198 are disposed adjacent the rear wall 160 and the front wall 158 of the storage body 146, respectively. The drive cup 194 is aligned with a drive arm aperture 214 formed in the rear wall 160 such that a rotating drive arm (not shown) of the auger motor 196 (shown schematically in FIG. 3) extends through the drive arm aperture 214 and engages the drive cup 194. In this manner, as the drive arm rotates about a second axis 'Y' (via the auger motor 196), the drive cup 194 and the auger 178 likewise rotate.

As shown in FIG. 6, a majority of the ice guide 198 is disposed within the ice storage compartment 162 and the cylinder 200 extends into the crusher compartment 176 and is received within the notch 170. As further shown, the second end 192 of the auger 178 extends into the crusher compartment 176 (i.e., through the cylinder 200 of the ice guide 198).

After the auger 178 is received within the ice storage compartment 162, the first drive gear 180 is inserted on and coupled to the second end 192 of the auger 178. In particular, the first drive gear 180 is attached to the second end 192 such that as the auger 178 rotates (via the auger motor 196), so too does the first drive gear 180. In other words, the first drive gear 180 is rotatably driven about the second axis 'Y' by the auger motor 196 (via the intermediary of the auger 178, itself).

Next, briefly moving back to FIG. 4, the second crusher roller 186 is inserted on the second axle 210 of the control rod 188 in a freely rotatable manner. That is, the second crusher roller 186 is rotatable on the second axle 210 while the second axle 210 remains stationary. Thereafter, the control rod 188 is installed on the storage body 146. Specifically, with respect to FIG. 5, the rear end 206 of the control rod 188 is inserted into the rod cut-out 168 and is translated along a longitudinal direction of the storage body 146 such that a distal end of the second axle 210 is received within the roller adjustment cut-out 166. Of note, the second axle 210 of the control rod 188 lies on a third axis 'Z' (depicted in FIG. 5) and the second crusher roller 186 is coaxial therewith. Said differently, the second crusher roller 186 is freely rotatable along the third axis 'Z.' The second crusher roller 186 is rotatably maintained upon the second axle 210 by the U-shaped front end 208 while the distal end of the second axle 210 is received within the roller adjustment cut-out 166.

Thereafter, the crusher cover 150 is secured to the storage body 146. In particular, as shown best in FIG. 6, the crusher housing 174 is secured to the front wall 158 of the storage body 146 such that respective distal ends of the second end 192 of the auger 178 and the first axle 204 are received within the first and second apertures 175*a*, 175*b* in the crusher housing 174, respectively. Each of the second end 192 of the auger 178 and the first axle 204 are supported by the crusher housing 174 via an intermediary bushing received within its associated aperture. In other words, the crusher housing 174 receives and supports distal ends of the second end 192 of the auger 178 and the first axle 204 such that both the auger 178 and the first axle 204 are freely rotatable about the second axis 'Y' and the first axis 'X,' respectively. Finally, the front cover 152 is disposed on and secured to the crusher cover 150 in a covering manner. While not shown in FIG. 6, insulation may be provided between the crusher cover 150 and the front cover 152 in order to insulate the ice maker 126 from the relatively warmer air within the fresh-food compartment 102.

Figure 5:
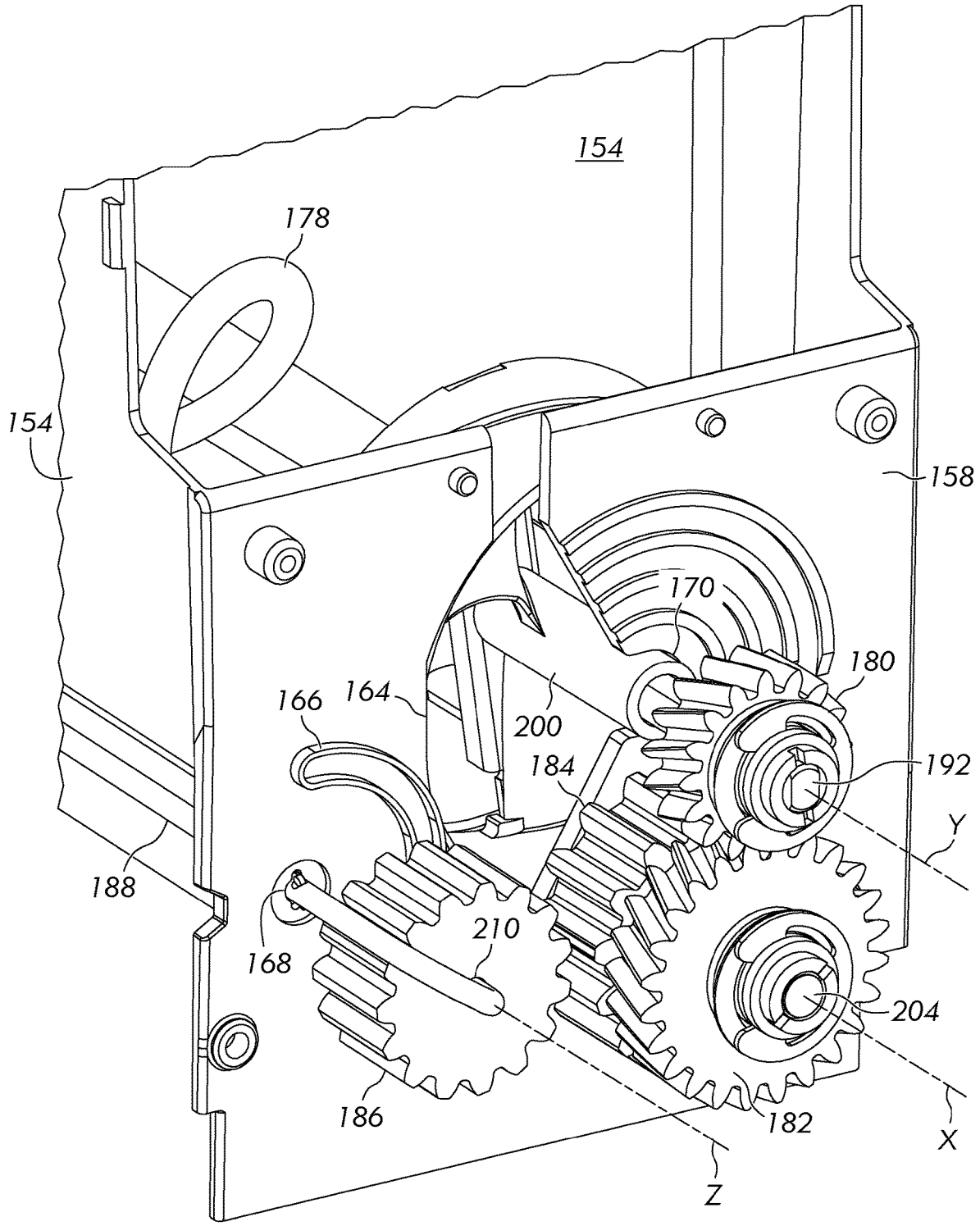
FIG. 5 is a partial, front perspective view of the conveyance and crusher assembly installed within the ice bin, with a front cover and a crusher cover thereof removed.

In the assembled state, the first and second drive gears 180, 182, and the first and second crusher rollers 184, 186 are all disposed within the crusher compartment 176. As best shown in FIG. 5, the first and second drive gears 180, 182 are aligned on a first common imaginary plane (being parallel to the front wall 158) and are dimensioned such that teeth of the first drive gear 180 matingly engage with teeth of the second drive gear 182. As further shown, the first and second axes 'X,''Y' are parallel with respect to one another, and the first axis 'X' is disposed vertically beneath the second axis 'Y.' Accordingly, the first drive gear 180 is disposed directly (vertically) above the second drive gear 182. Moreover, it is noted that the first axis 'X' is normal to the first common imaginary plane.

As further shown in FIG. 5, the first crusher roller 184 is disposed between the front wall 158 of the storage body 146 and the second drive gear 182. That is, the first crusher roller 184 is positioned closer to the front wall 158 of the storage body 146 than the second drive gear 182. As such, because the first and second drive gears 180, 182 are aligned on a common imaginary plane, and because the second drive gear 182 is provided at a spaced distance from the front wall 158, a spacer 216 (shown in FIG. 6) may be provided axially between the front wall 158 and the first drive gear 180 to ensure the first drive gear 180 remains aligned with the second drive gear 182.

Moreover, the first and third axes 'X,' 'Z' are parallel with respect to one another, and the third axis 'Z' is disposed laterally adjacent the first axis 'X.' Similar to the first and second drive gears 180, 182, the first and second crusher rollers 184, 186 are aligned on a separate, second common imaginary plane and are spaced from one another. Notably, the first and second crusher rollers 184, 186 are laterally spaced from one another such that their respective teeth do not contact/engage one another. Accordingly, as will be discussed further below, the second crusher roller 186 is freely rotatable (on the second axle 210) independent from the first crusher roller 184. Moreover, it is noted that the first axis 'X' is normal to the second common imaginary plane.

As further shown in FIG. 5, the control rod 188 is disposed outside of the ice storage compartment 162, and extends longitudinally along an external surface of one of the side walls 154 of the storage body 146. Notably, as will be discussed further below, the control rod 188 is rotatable such that the distal end of the second axle 210 (which is received within the roller adjustment cut-out 166) is slidable within the roller adjustment cut-out 166. Accordingly, the control rod 188 is not fully rotatable (i.e., about 360°), but rather the control rod 188 is rotatable to the extent that the distal end of the second axle 210 is slidable within the roller adjustment cut-out 166. Said differently, rotation of the control rod 188 is bounded by the arc-shaped geometry of the roller adjustment cut-out 166. Accordingly, unlike the first and second axes 'X,' 'Y,' which are both stationary, the third axis 'Z' is translatable along the arc-shaped roller adjustment cut-out 166, as will be discussed further below.

Function and operation of the conveyance and crusher assembly 148 within the ice bin 124 will now be discussed. It is to be understood that the below operational steps need not occur in the order expressed below. Initially, with respect to FIG. 3, ice pieces are manufactured by the ice maker 126 and are discharged from the ice tray 142 and into the ice bin 124. More specifically, the ice pieces are discharged into the ice storage compartment 162 of the storage body 146 (depicted in FIG. 4). With respect to FIG. 6, when ice pieces are requested for dispensing (via user request), the auger 178 is rotated about the second axis 'Y' by the auger motor 196 (shown in FIG. 3). More specifically, because the drive arm (not shown) of the auger motor 196 is received within the drive cup 194, as the drive arm rotates about the second axis 'Y,' so too does the auger 178. As the auger 178 rotates, ice pieces stored within the ice storage compartment 162 are transported forwards (i.e., in a direction from the rear wall 160 of the storage body 146 towards the front wall 158 thereof).

As the ice pieces approach the front wall 158 of the storage body 146, the ice guide 198 manages the transportation of 'whole' ice pieces from the ice storage compartment 162 into the crusher compartment 176. Specifically, the slide 202 of the ice guide 198 controls an amount of ice pieces attempted to be transported into the crusher compartment 176 and guides said ice pieces through the conveyance cut-out 164 in the front wall 158 of the storage body 146. Accordingly, the ice guide 198, and more particularly, the slide 202 hinders jamming of ice pieces attempting to be transported from the ice storage compartment 162 into the crusher compartment 176.

As mentioned above, the first drive gear 180 is rotatably driven about the second axis 'Y' by the auger motor 196 (via the intermediary of the auger 178 itself). As such, as the auger 178 rotates to transport ice pieces from the ice storage compartment 162 into the crusher compartment 176, the first drive gear 180 likewise rotates. With respect to FIG. 5 and as discussed above, the teeth of the first drive gear 180 matingly engage with the teeth of the second drive gear 182. As such, when the first drive gear 180 is rotatably driven about the second axis 'Y,' the second drive gear 182 is thereby driven about the first axis 'X.' In other words, the first drive gear 180 rotatably drives the second drive gear 182.

As also mentioned above, the second drive gear 182 and the first crusher roller 184 are both attached to the first axle 204, which is rotatable about the first axis 'X.' Accordingly, rotation of the second drive gear 182 (via the first drive gear 180) yields rotation of the first crusher roller 184 (about the first axis 'X') via their corresponding attachment to the common first axle 204. In other words, the first axle 204 is rotatably received within the axle cut-out 169 and is rotatably driven via the mating engagement between the first and second drive gears 180, 182.

Figure 7A:
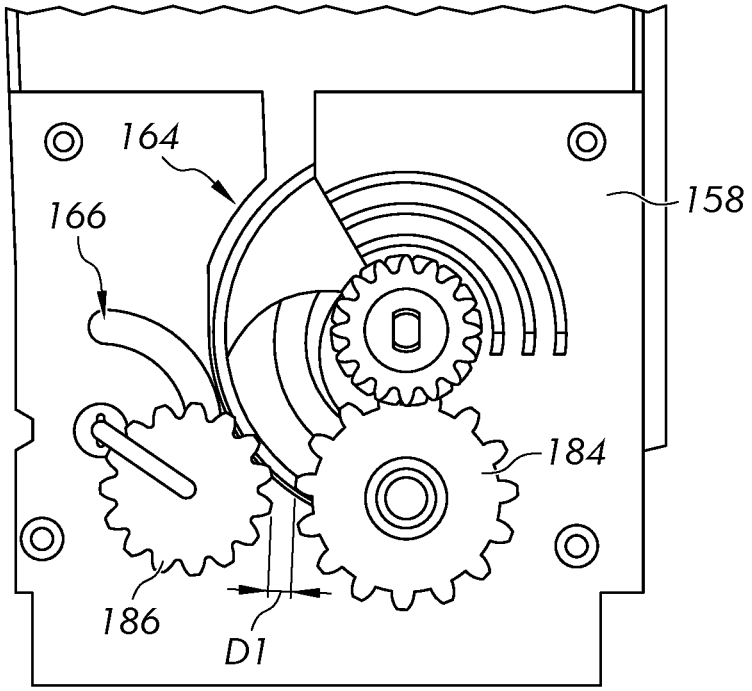
FIG. 7A is a front view of the conveyance and crusher assembly installed within the ice bin (with the front cover and crusher cover thereof removed), depicting a second crusher roller in a first position.
Figure 7B:
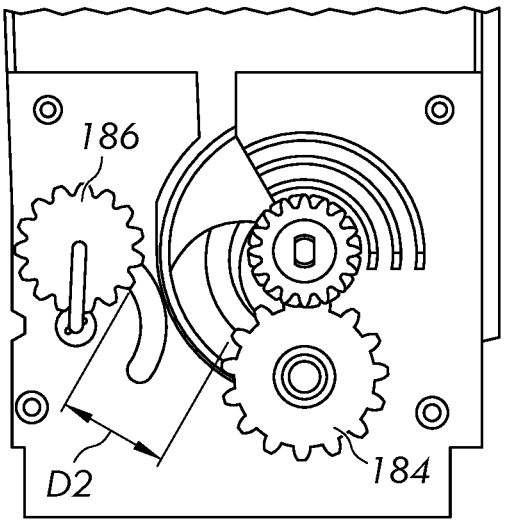
FIG. 7B is a front view of the conveyance and crusher assembly installed within the ice bin (with the front cover and crusher cover thereof removed), depicting the second crusher roller in a second position.
Figure 7C:
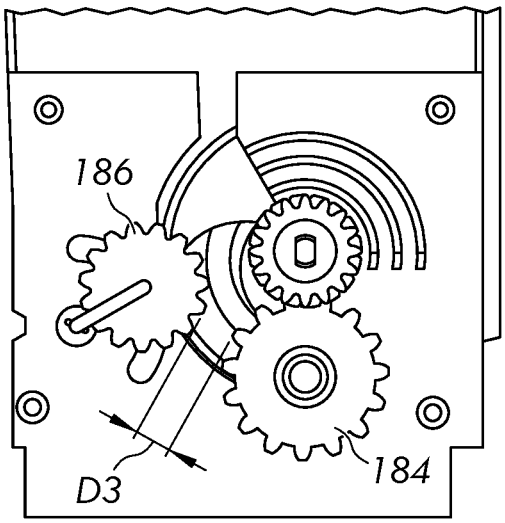
FIG. 7C is a front view of the conveyance and crusher assembly installed within the ice bin (with the front cover and crusher cover thereof removed), depicting the second crusher roller in a third position.

As the 'whole' ice pieces pass into the crusher compartment 176 (via the conveyance cut-out 164) the 'whole' ice pieces may be crushed between the first and second crusher rollers 184, 186. In particular, the rotating first crusher roller 184 is rotatably driven (e.g., in a counter-clockwise direction as illustrated in FIGS. 7A-7C) in order to forcibly guide the ice pieces vertically downwards. As the 'whole' ice pieces are guided downwards, said ice pieces can be ground and broken up in the gap space between the rotatably driven first crusher roller 184 and the freely rotatable second crusher roller 186 to produce 'crushed' ice pieces. That is, the first crusher roller 184 actively rotates to drive the ice pieces downwards, and the second crusher roller 186 is placed in close proximity to the first crusher roller 184 such that the ice pieces are sandwiched therebetween and ground down from 'whole' ice pieces into 'crushed' ice pieces. As can be appreciated, the second crusher roller 186 need only be freely rotatable about the third axis 'Z.' That is, the second crusher roller 186 is not 'driven' (via a motor) about the third axis 'Z.' This is possible because the second crusher roller 186 acts as both a guide and an opposing force to the ice pieces since it does not move laterally during the crushing process. In other words, the first crusher roller 184 actively drives the ice pieces downwards and into engagement with the second crusher roller 186. Because the second crusher roller 186 is placed in close proximity to the first crusher roller 184, the ice pieces are forced therebetween and are ground down to a smaller size. Notably, the second crusher roller 186 freely rotates about the third axis 'Z,' when necessary to advance the production of 'crushed' ice pieces (i.e., to permit the ground and broken ice to fall vertically downwards, out of the crusher compartment 176).

Based on a set distance between the first and second crusher rollers 184, 186, the ice pieces can be crushed into a desired size. Specifically, with respect to FIG. 7A (depicting a front view of the conveyance and crusher assembly 148, with the second drive gear 182 removed for simplicity), the second crusher roller 186 is depicted in a first position, wherein a first distance D1 between an outer circumference of the first crusher roller 184 and an outer circumference of the second crusher roller 186 is smallest. More specifically, the first distance D1 is the minimum possible distance permitted between the first and second crusher rollers 184, 186 based upon the roller adjustment cut-out 166. Notably, the relative dimensioning between the first and second crusher rollers 184, 186, when the second crusher roller 186 is in the first position, is small enough such that ice pieces being forcibly guided vertically downwards (by the first crusher roller 184) are ground between the first and second crusher rollers 184, 186 into 'crushed' ice pieces, having a smallest possible size.

Now moving on to FIG. 7B, the second crusher roller 186 has been moved from the first position to a second position. Notably, as best shown in FIG. 5, this is accomplished by rotating the control rod 188 such that the distal end of the second axle 210 (which is received within the roller adjustment cut-out 166) slides within the roller adjustment cut-out 166 in a direction away from the first crusher roller 184. When the second crusher roller 186 is placed in the second position (shown in FIG. 7B), the second crusher roller 186 is spaced from the first crusher roller 184 by a second distance D2. Notably, the second distance D2 is greater than the first distance D1, and is the maximum possible distance permitted between the first and second crusher rollers 184, 186. During operation, when the second crusher roller 186 is placed in the second position, the second distance D2 is large enough such that the 'whole' ice pieces pass between the first and second crusher rollers 184, 186 without being ground. Said differently, the second crusher roller 186 is positioned out of the way such that the 'whole' ice pieces entering the crusher compartment 176 will only engage the first crusher roller 184; the ice pieces will not be forcibly sandwiched between the first and second crusher rollers 184, 186. In this manner, the ice pieces may be dispensed in 'whole cube' form.

Finally, with respect to FIG. 7C, the second crusher roller 186 can be moved to a third position which is intermediate the two extreme first and second positions. In particular, when the second crusher roller 186 is in the third position, the second crusher roller 186 is spaced from the first crusher roller 184 by a third distance D3, which is greater than the first distance D1, but less than the second distance D2. In other words, the third position yields a placement of the second crusher roller 186 between a maximum possible distance and minimum possible distance away from the first crusher roller 184. During operation, when the second crusher roller 186 is placed in the third position, the 'whole' ice pieces entering the crusher compartment 176 will be sandwiched between the first and second crusher rollers 184, 186 and ground into 'crushed' ice pieces. However, the relative size of the 'crushed' ice pieces will be larger than that produced when the second crusher roller 186 is in the first position. This is due to the third distance D3 between the first and second crusher rollers 184, 186 (when the second crusher roller 186 is in the third position) being greater than the first distance D1 between the first and second crusher rollers 184, 186 (when the second crusher roller 186 is in the first position). In other words, the third distance D3 between the first and second crusher rollers 184, 186 is small enough to permit the ice pieces to be sandwiched between the first and second crusher rollers 184, 186, but also large enough such that the ice pieces (in 'whole cube' form) are not completely pulverized into finely sized 'crushed' ice pieces.

Of note, the rotatable position of the control rod 188, and thus the position of the second crusher roller 186, can be adjusted manually (e.g., via a user rotating the control rod 188). Alternatively, the position of the second crusher roller 186 can be adjusted mechanically. For example, a variable solenoid (not shown) can control a lever mechanism (not shown) to adjust a rotatable position of the control rod 188, and thus the position of the second crusher roller 186. The solenoid may be activated based on a user selection on a user interface (e.g., buttons, slides, dials, etc.). Alternatively, an electric motor could also be used to rotate the control rod 188 in a similar manner. For example, if a user selects a button related to finely 'crushed' ice pieces, the solenoid will ensure the control rod 188 is adjusted to place the second crusher roller 186 in the first position. Alternatively, if the user selects a button related to 'whole cube' ice pieces, the solenoid ensures the control rod 188 is adjusted (i.e., rotated) to place the second crusher roller 186 in the second position. It is to be understood that the second crusher roller 186 is not limited to the above-noted three positions. Rather, the second crusher roller 186 can be moved to any position between the first and second positions in order to produce variably sized 'crushed' ice pieces for dispensing. That is, although one "third position" was described above, it is to be appreciated that the second crush roller 186 can be moved to any number of intermediate positions between the first and second positions. In one example, the width D3 of the third position can be infinitely adjustable to any value between D1 and D2 to provide a high degree of control over the size of the 'crushed' ice pieces. In another embodiment, the width D3 of the third position can be adjustable among a predetermined number of pre-determined values between D1 and D2 to provide a discrete control over the size of the 'crushed' ice pieces.

Briefly moving back to FIG. 6, after the ice pieces are crushed (or not crushed, if the second crusher roller 186 is placed in the second position) the ice pieces then fall (via gravity) out of the crusher compartment (via the aperture 128 formed in a bottom of the crusher housing 174) and into the ice chute 130 (depicted in FIG. 2) to be guided to the dispenser 122 (shown in FIG. 1).

In sum, the aforementioned ice bin 124 includes the conveyance and crusher assembly 148 that promotes both the conveyance of 'whole' ice pieces and the pulverization of said 'whole' ice pieces into 'crushed' ice pieces based on a single, common power plant (i.e., the auger motor 196). This is accomplished by the first crusher roller 184 being rotatably driven by the auger motor 196 via an intermediary drive train (i.e., the first and second drive gears 180, 182), and the second crusher roller 186 being freely rotatable about the second axle 210 of the control rod 188. The example embodiment discussed above simplifies the overall design of the ice bin 124 and reduces cost, as only a single motor (i.e., the auger motor 196) is needed to operate the conveyance and crusher assembly 148. Further, the conveyance and crusher assembly 148 includes the first and second crusher rollers 184, 186, which are not susceptible to the disadvantages (e.g., bending, dulling, etc.) associated with blade-type crusher assemblies. The use of the first and second crusher rollers 184, 186, rather than blades, ensures more consistent 'crushed' ice pieces. Finally, the second crusher roller 186 being movable with respect to the first crusher roller 184, as described above, produces variable sized, 'crushed' ice pieces, or even 'whole cubed' ice pieces, depending on user selection/request.

Various alternative embodiments of the conveyance and crusher assembly will now be described with respect to FIGS. 8-11. For brevity, only features that differ from the first embodiment of the conveyance and crusher assembly 148 discussed above will be described in detail.

Figure 8:
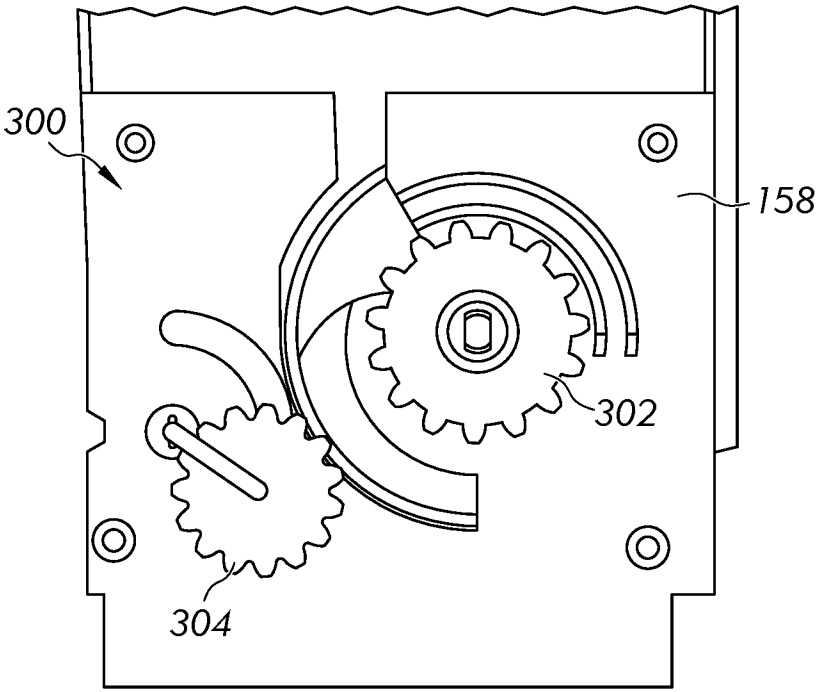
FIG. 8 is a front view of a second embodiment of a conveyance and crusher assembly installed within an ice bin (with a front cover and crusher cover thereof removed)

With respect to FIG. 8, a second embodiment of a conveyance and crusher assembly 300 is shown. Notably, the depicted conveyance and crusher assembly 300 includes a first crusher roller 302 and a second crusher roller 304. The first crusher roller 302 is directly coupled to the second end 192 of the auger 178 such that as the auger 178 rotates (as described above), the first crusher roller 302 likewise rotates. In other words, the first crusher roller 302 is rotatably driven about an axis (e.g., the second axis 'Y' shown in FIG. 6) by the auger motor 196 (via the intermediary of the auger 178 itself).

FIG. 8 depicts the first and second crusher rollers 302, 304 as spur gears. However, it is contemplated that the first and second crusher rollers 302, 304 can be a different type of gear (e.g., helical gears, etc.). Moreover, the first crusher roller 302 can be one type of gear while the second crusher roller 304 is a different type of gear. Further still, in the depicted embodiment, an outer diameter of the first crusher roller 302 is greater than an outer diameter of the second crusher roller 304. However, it is contemplated that the second crusher roller 304 can have an outer diameter greater than that of the first crusher roller 302, or even that the respective outer diameters of the first and second crusher rollers 302, 304 are equal.

The first crusher roller 302 can be spaced from the front wall 158 of the storage body 146 via the spacer 216 (shown in FIG. 6). Alternatively, the first crusher roller 302 can be disposed directly adjacent to the front wall 158 such that no intervening members are disposed therebetween. Moreover, the first and second crusher rollers 302, 304 can reside on a common imaginary plane of which the second axis 'Y' is normal to. However, it is contemplated that the first and second crusher rollers 302, 304 can be axially offset from one another, such that they are disposed on different, respective imaginary planes (both being normal to the 'Y' axis).

In comparison to the first embodiment of the conveyance and crusher assembly 148 described above, the second embodiment of the conveyance and crusher assembly 300 does not utilize an intermediary drive train. That is, the second embodiment of the conveyance and crusher assembly 300 has no drive gears (e.g., drive gears 180, 182). Rather, the first crusher roller 302 is connected directly to the second end 192 of the auger 178. As such, the conveyance and crusher assembly 300 has only a total of two gear-like elements between which the ice is crushed, namely the first and second crusher rollers 302, 304.

Figure 9:
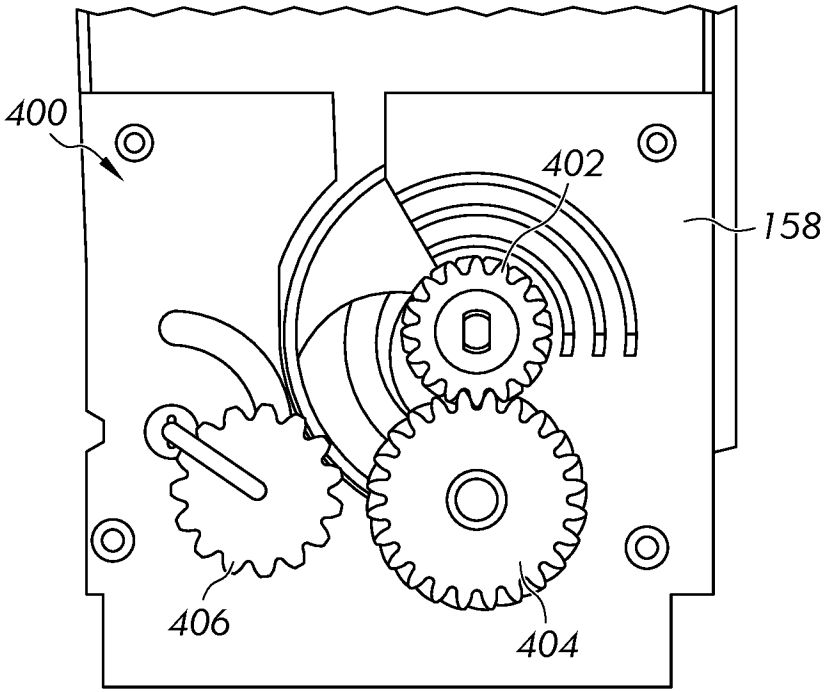
FIG. 9 is a front view of a third embodiment of a conveyance and crusher assembly installed within an ice bin (with a front cover and crusher cover thereof removed)

Moving now to FIG. 9, a third embodiment of a conveyance and crusher assembly 400 is shown. Specifically, the conveyance and crusher assembly 400 includes a drive gear 402, a first crusher roller 404, and a second crusher roller 406. Similar to the first embodiment described above, the drive gear 402 is directly coupled to the second end 192 of the auger 178 such that as the auger 178 rotates (as described above), the drive gear 402 likewise rotates. In other words, the drive gear 402 is rotatably driven about an axis (e.g., the second axis 'Y' shown in FIG. 6) by the auger motor 196 (via the intermediary of the auger 178 itself).

The first crusher roller 404 is rotatably provided on the first axle and is dimensioned and configured to mesh with the drive gear 402. In this manner, as the drive gear 402 rotates (e.g., in a counter-clockwise direction) the first crusher roller 404 likewise rotates (about the first axle 204) in an opposite direction (e.g., a clockwise direction), and the ice is crushed between the first and second crusher rollers 404, 406. The drive gear 402 can be spaced from the front wall 158 of the storage body 146 (e.g., via the spacer 216 shown in FIG. 6), or the drive gear 402 can be disposed directly adjacent to the front wall 158 such that no intervening members (e.g., gears, rollers, spacers, etc.) are positioned therebetween. Moreover, the drive gear 402, the first crusher roller 404, and the second crusher roller 406 can all reside on a common imaginary plane. Alternatively, one of the drive gear 402, the first crusher roller 404, and the second crusher roller 406 can reside on a first imaginary plane and the others can reside on a separate, second imaginary plane. Further still, the drive gear 402, the first crusher roller 404, and the second crusher roller 406 can all reside on separate, respective imaginary horizontal planes (i.e., all of which the second axis 'Y' is normal to).

As further shown, the first crusher roller 404 is depicted as being a helical gear whereas the second crusher roller 406 is depicted as being a spur gear. It is to be understood that the first and second crusher rollers 404, 406 can be the same type of gear, and can be any type of gear, so long as the first crusher roller 404 is capable of being rotatably driven via the drive gear 402. In comparison to the first embodiment of the conveyance and crusher assembly 148 described above, the third embodiment of the conveyance and crusher assembly 400 employs an intermediary drive train, but said drive train only comprises of a single gear—the drive gear 402. As such, the conveyance and crusher assembly 400 has only a total of three gear-like elements, as compared to the total of four gear-like elements described above with respect to the first embodiment.

Figure 10:
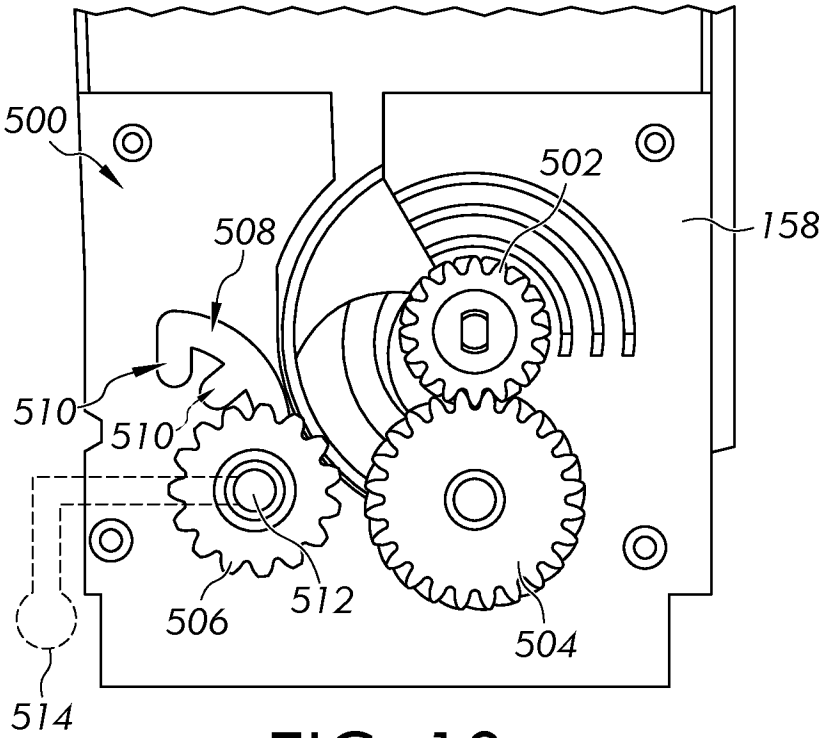
FIG. 10 is a front view of a fourth embodiment of a conveyance and crusher assembly installed within an ice bin (with a front cover and crusher cover thereof removed)

Now with respect FIG. 10, a fourth embodiment of a conveyance and crusher assembly 500 is shown. Specifically, the conveyance and crusher assembly 500 includes a drive gear 502, a first crusher roller 504, and a second crusher roller 506. In other words, the conveyance and crusher assembly 500 has the same general configuration (i.e., having a total of three gear-like elements) as that of the third embodiment of the conveyance and crusher assembly 400 discussed above, and the ice is crushed between the first and second crusher rollers 504, 506. As depicted, a roller adjustment cut-out 508 is formed in the front wall 158 of the storage body 146. The roller adjustment cut-out 508 has a general arc-like shape, but also includes a series of discrete slots 510. Each slot 510 extends radially inward, for example towards a center point of the arc-like shape.

The second crush roller 506 is rotatably moved about an axle 512 that is slidable (i.e., translatable) within the roller adjustment cut-out 508. More specifically, the second crusher roller 506 is disposed at a first distal end of the axle 512 and the second distal end is received within the roller adjustment cut-out 508. A back-stop or anchor (not shown) may be movably secured to a rear surface of the front wall 158, and the second distal end of the axle 512 can be attached to said back-stop in order to prevent the axle 512 from axially moving and becoming dislodged from the roller adjustment cut-out 508. It is to be understood that other such securement methods are contemplated in that any particular manner may be employed to ensure that the axle 512 remains slidable within the roller adjustment cut-out 508, while hindering or preventing the axle 512 from coming dislodged therefrom.

Each slot 510 in the roller adjustment cut-out 508 is configured to receive the axle therein 512. Accordingly, the series of slots 510 correspond to a plurality of separate and predetermined positions where the axle 512 can be placed, which provides a discrete set of predetermined spacing gaps between the first and second crusher rollers 504, 506 that correspond to relatively smaller or larger ice crush sizes. The geometric configuration of each slot 510 ensures correct placement of the axle 512 and helps to keep the axle 512 coaxial with an imaginary axis (e.g., the third axis 'Z,' depicted in FIG. 5). That is, during an ice crushing operation, lateral forces are applied to the second crusher roller 506 from the ice being crushed and these forces which are imparted onto the axle 512 are thereby absorbed by the front wall 158 via the slots 510. In operation, in order to translate the axle 512 within the roller adjustment cut-out 508 (and thus translate the position of the second crusher roller 506 with respect to the first crusher roller 504) a user engages a handle 514 (schematically depicted in FIG. 10) to move the axle 512. Notably, the handle 514 can be attached to the first distal end of the axle 512 or even formed integral with the axle 512. The user then moves the handle 514 to translate the axle 512 within the roller adjustment cut-out 508 (i.e., from one slot 510 to a different slot 510) to select a desired size of ice pieces to be crushed and dispensed. While a manual handle 514 is illustrated, it is to be appreciated that the handle 514 could also be motorized via an electric motor (not shown) operatively connected thereto which moves the axle 512 within the roller adjustment cut-out 508 based upon input commands into a user interface of the appliance.

Of note, while the embodiment depicted in FIG. 10 is substantially similar to that shown in FIG. 9 in that there are a total of three gear-like elements, it is to be understood that the above-described roller adjustment cut-out 508 and its corresponding features can be applied to any one of the previously described embodiments (i.e., a conveyance and crusher assembly having two gear-like elements, or four gear-like elements). Moreover, it is to be understood that the geometric configuration of the roller adjustment cut-out 508 is not limited to including the depicted and aforementioned described slots 510. Rather, other configurations are contemplated, such as a series of teeth disposed about the arc-like shape of the roller adjustment cut-out 508.

Figure 11:
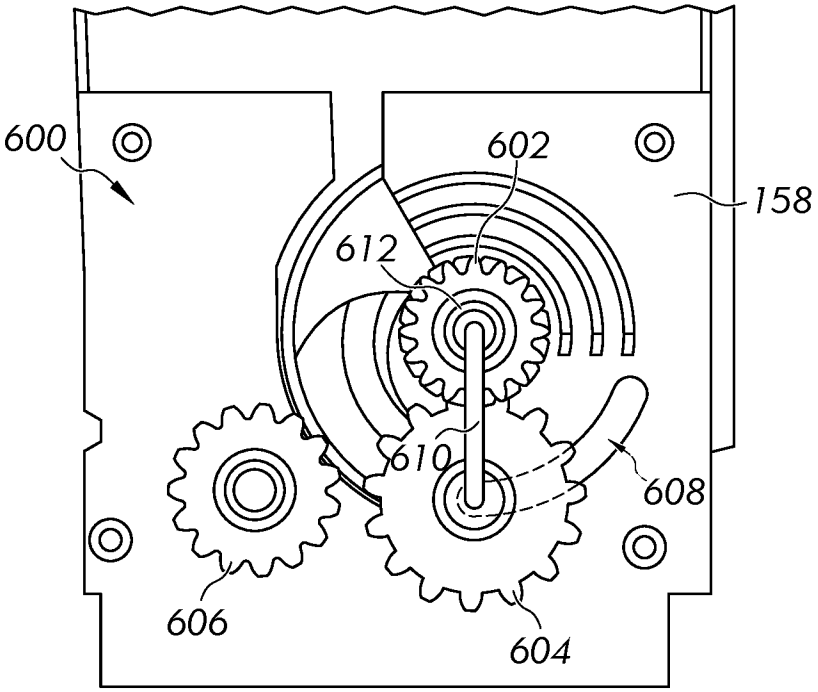
FIG. 11 is a front view of a fifth embodiment of a conveyance and crusher assembly installed within an ice bin (with a front cover and crusher cover thereof removed)

Moving on to FIG. 11, a fifth embodiment of a conveyance and crusher assembly 600 is shown. Specifically, the conveyance and crusher assembly 600 includes a drive gear 602, a first crusher roller 604, and a second crusher roller 606. That is, the conveyance and crusher assembly 600 has the same general configuration (i.e., having a total of three gear-like elements) as that of the third and fourth embodiment of the conveyance and crusher assembly 400, 500 discussed above. However, it is contemplated that the conveyance and crusher assembly 600 could instead include four gear-like elements (as shown in FIG. 5 and described with respect to the first embodiment).

Unlike the above-mentioned embodiments, the second crusher roller 606 of this conveyance and crusher assembly 600 is not configured to be adjustable. Rather, a position of the first crusher roller 604 is adjustable with respect to a position of the second crusher roller 606. This is accomplished by providing a roller adjustment cut-out 608 in the front wall 158 and at a general position associated with the first crusher roller 604. Here, the first crusher roller 604 is rotatably secured to a first end portion of a guide rod 610. A second end portion of the guide rod 610 can be rotatably supported by the drive gear 602. For example, the drive gear 602 may have a central recess formed therein configured to accept a distal end of the second end portion of the guide rod 610. A bushing 612 (e.g., a ball-bearing, etc.) can likewise be received within the recess and disposed radially between the distal end of the second end portion of the guide rod 610 and a surface of the recess to facilitate independent movement of both the drive gear 602 and the guide rod 610.

In operation, the guide rod 610 is rotatable about its second end portion (e.g., about the second axis 'Y,' shown in FIG. 5) such that its first end portion is slidable (i.e., translatable) within the arc-shaped roller adjustment cut-out 608. Notably, due to the bushing 612, the drive gear 602 is able to rotate without affecting (i.e., changing) a position of the guide rod 610. In this manner, the second end portion of the guide rod 610 is (rotatably) supported by the drive gear 602 (via the intermediary bushing 612). As the first end portion of the guide rod 610 slides within the roller adjustment cut-out 608, a position of the first crusher roller 604 changes with respect to the second crusher roller 606, thus allowing for varying sized ice pieces to be dispensed, as described above. Movement of the first end portion of the guide rod 610 can be controlled by a motor (not shown) or even by direct user interaction. Although not shown, the cut-out 608 could include one or more predetermined slots similar to those slots 510 in FIG. 10 for receiving the first end portion of the guide rod 610.

Figure 12:
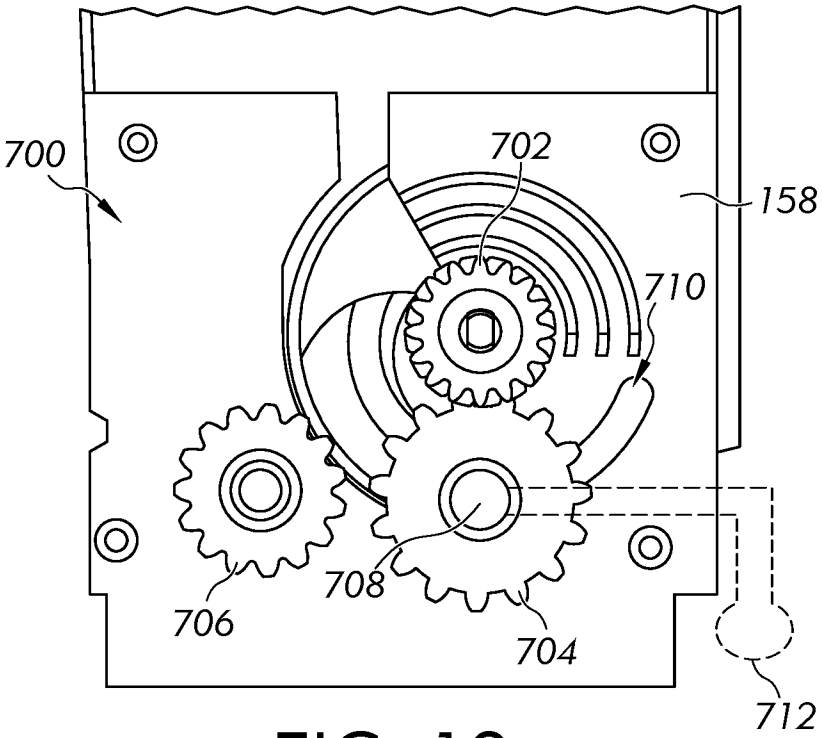
FIG. 12 is a front view of a sixth embodiment of a conveyance and crusher assembly installed within an ice bin (with a front cover and crusher cover thereof removed).

Finally, with respect to FIG. 12, a sixth embodiment of a conveyance and crusher assembly 700 is shown. Similar to the fifth embodiment, the conveyance and crusher assembly 700 includes three gear-like elements, namely a drive gear 702, a first crusher roller 704, and a second crusher roller 706. However, it is contemplated that the conveyance and crusher assembly 700 described herein could have four gear-like elements. Again, similar to the fifth embodiment, a position of the first crusher roller 704 is adjustable with respect to the second crusher roller 706. In particular, the first crusher roller 704 is rotatably secured to an axle 708. Notably, the axle 708 is similar in structure and function to that of the axle 512 described with respect to the fourth embodiment of the conveyance and crusher assembly 500 depicted in FIG. 10. That is, the axle 708 is slidable within an arc-shaped roller adjustment cut-out 710. Here, the position of the axle 708 (and thus the position of the first crusher roller 704) is slidable by a user engaging a handle 712 (schematically depicted in FIG. 12) to move the axle 708. Notably, the handle 712 can be attached to a distal end of the axle 708 or even formed integral with the axle 708. The user moves the handle 712 to translate the axle 708 within the roller adjustment cut-out 710 to select a desired size of ice pieces to be dispensed. Moreover, the position of the second crusher roller 706 is not movable (i.e., translatable) with respect to the position of the first crusher roller 704. Although not shown, the cut-out 710 could include one or more predetermined slots similar to those slots 510 in FIG. 10 for receiving the first end portion of the axle 708. While a manual handle 712 is illustrated, it is to be appreciated that the handle 712 could also be motorized via an electric motor (not shown) operatively connected thereto which moves the axle 708 within the roller adjustment cut-out 710 based upon input commands into a user interface of the appliance.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. An ice bin for a refrigerator appliance, the ice bin comprising:

a storage body defining an ice storage compartment therein configured to receive and store produced ice pieces;

an auger rotatably driven by an auger motor, the auger extending within the storage body and having first and second ends;

a first drive gear disposed at the second end of the auger and coupled thereto to rotate together with the auger;

a second drive gear disposed on a first axle extending along a first axis, the first axis being parallel to a second axis on which the auger is rotatably driven, the second drive gear configured to rotate about the first axis, and the second drive gear matingly engaging the first drive gear;

a first crusher roller disposed on the first axle and configured to rotate together with the second drive gear such that the first crusher roller is rotatably driven by the auger motor; and a second crusher roller disposed on a second axle extending along a third axis, the second crusher roller being rotatable about the second axle, wherein the second crusher roller is movable between a first position and a second position, and wherein when the second crusher roller is in the first position the first crusher roller and the second crusher roller are spatially arranged and configured to grind the produced ice pieces into crushed ice.

2. The ice bin of claim 1, wherein the second end of the auger extends out of the ice storage compartment and into a crusher compartment, and wherein the first drive gear, the second drive gear, the first crusher roller, and the second crusher roller are all disposed within the crusher compartment.

3. The ice bin of claim 1, further comprising a crusher cover disposed adjacent a front wall of the storage body and outside of the ice storage compartment, the crusher cover defining a crusher compartment together with the front wall, wherein the auger is configured to transport the produced ice pieces from the ice storage compartment, through a conveyance cut-out formed in the front wall, and into the crusher compartment.

4. The ice bin of claim 1, wherein when the second crusher roller is in the first position, the second crusher roller is spaced from the first crusher roller by a first distance, and wherein when the second crusher roller is in the second position, the second crusher roller is spaced from the first crusher roller by a second distance that is greater than the first distance.

5. The ice bin of claim 1, wherein when the second crusher roller is in the second position, the first crusher roller and the second crusher roller are spatially arranged such that the produced ice pieces are not ground into crushed ice.

6. The ice bin of claim 1, wherein the first drive gear and the second drive gear are aligned on a first common imaginary plane, wherein the first crusher roller and the second crusher roller are aligned on a second common imaginary plane, and wherein the first axis is normal to each of the first and second common imaginary planes.

7. The ice bin of claim 6, wherein the storage body includes a front wall, wherein the second common imaginary plane is positioned closer to the front wall of the storage body than the first common imaginary plane.

8. The ice bin of claim 1, wherein the second crusher roller is movable, in an imaginary plane, towards or away from the first crusher roller, and wherein the third axis is normal to the imaginary plane.

* * * * *